US007159500B2

(12) United States Patent
John et al.

(10) Patent No.: US 7,159,500 B2
(45) Date of Patent: Jan. 9, 2007

(54) PUBLIC NETWORK WEAPON SYSTEM AND METHOD

(75) Inventors: Goree John, San Francisco, CA (US); Feldman Brian, San Francisco, CA (US)

(73) Assignee: The Telerobotics Corporation, Sausalito, CA (US)

( * ) Notice: Subject to any disclaimer, the term of this patent is extended or adjusted under 35 U.S.C. 154(b) by 41 days.

(21) Appl. No.: 10/963,956

(22) Filed: Oct. 12, 2004

(65) Prior Publication Data

US 2006/0249010 A1 Nov. 9, 2006

(51) Int. Cl.
*F41F 1/00* (2006.01)

(52) U.S. Cl. ..... 89/1.11

(58) Field of Classification Search ..... 89/1.11; 235/400, 404

See application file for complete search history.

(56) References Cited

U.S. PATENT DOCUMENTS 5,631,437 A * 5/1997 LaVigna et al. ..... 89/14.3
5,682,006 A * 10/1997 Perry et al. ..... 89/41.01
5,691,898 A * 11/1997 Rosenberg et al. ..... 700/85
5,903,735 A * 5/1999 Kidder et al. ..... 709/240
6,198,404 B1 * 3/2001 Campagnuolo et al. .. 340/691.2
6,899,539 B1 * 5/2005 Stallman et al. ..... 434/11
6,955,296 B1 * 10/2005 Lusher et al. ..... 235/400
6,986,302 B1 * 1/2006 LaFata ..... 89/1.11
2003/0045355 A1 * 3/2003 Comair ..... 463/40
2003/0092492 A1 * 5/2003 Ishii et al. ..... 463/42
2003/0136900 A1 * 7/2003 Shechter et al. ..... 250/222.1
2003/0191568 A1 * 10/2003 Breed ..... 701/36

OTHER PUBLICATIONS

Unkown Author, "Live Shot", internet publication, archived at http://web.archive.org/web/20040208132321/http://www.live-shot.com/howitworks.html.*

* cited by examiner

*Primary Examiner*—Michael J. Carone
*Assistant Examiner*—Bret Hayes
(74) *Attorney, Agent, or Firm*—Dalina Law Group, P.C.

(57) ABSTRACT

Embodiments of the invention enable the dynamic discovery and operation of at least one over a public network such as the Internet. The system may comprise dynamically discoverable sensors such as a video camera or video surveillance system or any other type of sensor capable of detecting a target. Sensors may be collocated or distantly located from weapons and there may be a different number of weapons and sensors in a configuration. An operator may control more than one weapon at a time and may obtain sensor data output from more than one sensor at a time. One or more weapons may be aimed simultaneously by performing a user gesture such as a mouse click or game controller button selection with respect to a particular sensor data output. An operator user interface may be cloned onto another computer for real-time supervision or for later analysis or training for example.

82 Claims, 13 Drawing Sheets

Fig. 12

Content-Type: multipart/mixed;
boundary="_=_next_part_-560821453_=_"
MIME-Version: 1.0
--_=_next_part_-506284153_=_
Content-Type: text/plain 1200 This is a sensor data output message ecoded image --_=_next_part_-506284153_=_
Content-Type: image/jpeg
Content-Transfer-Encoding: base64

1201
VhGpcyBGpcyBGhIHBGhcnQGgaW4GgYSAGobX
VGsdGlGwYXJG0KSBGtZXNGzYWdGIIGdGlbmG
HIRoZSIBSb2Id1ZSIBXYXIZIIFINvdXIJjZVIBybyIB
OZXIQgcHIJvZHIVjdCI4NCgI0KQWI
XYJ0cyYBvZiYB0aGYIzIGY1Ic3YNhZ2YUgYXYJII
GYIkZWY50aWYNhbCYwgaGY93ZXYZIcYi
WZ4gZWZ5jb2ZRIZCZBmb3ZIgdHZJhbnZNwb3Z
J0IHZVzaWZ5nIGZRpZmZZIcmZVud
....
--_=_next_part_-506284153_=_--

1202 .... (as many as we can package at once here)

Fig. 13

1300

```
<WEAPON_COMMAND>
 <TIME_TO_FIRE>
  20041005133945
 </TIME_TO_FIRE>
 <NUMBER_OF_ROUNDS>
  5
 </NUMBER_OF_ROUNDS>
</WEAPON_COMMAND>
```

1301

```
<SENSOR_COMMAND>
 <MOVEMENT>
  <PAN>
   10.5
  </PAN>
 </MOVEMENT>
 <THROTTLE>
  <RESOLUTION>
   640x480
  </RESOLUTION>
  <DEPTH>
   8
  </DEPTH>
 </THROTTLE>
</SENSOR_COMMAND>
```

PUBLIC NETWORK WEAPON SYSTEM AND METHOD

BACKGROUND OF THE INVENTION

1. Field of the Invention

Embodiments of the invention described herein pertain to the field of weapon systems and methods. More particularly, but not by way of limitation, these embodiments enable an operator to interact with at least one weapon and/or at least one sensor over a public network such as the Internet.

2. Description of the Related Art

A public network is any computer network accessible by a member of the public, such as the Internet. Public networks have limitations in throughput, latency and security that restrict the amount of data, time delay of the data and type of data that is sent on the public network with respect to private networks such as a LAN. A remote weapon system allows for remote operation of a weapon without requiring direct physical collocation of a user with the weapon. Remotely operating a weapon may include aiming the weapon and firing the weapon for example. To date there are no known weapons systems that may be remotely operated over a public network.

Current small arms weapons systems are not network enabled devices and to date only allow for remote firing of a single rifle at a time over a direct hardwired link. Current systems do not allow for multiple remote weapons and/or sensors to be dynamically discovered, allocated and utilized by one or more operators. Current systems are not capable of operating on a public network with the inherent limitations of public networks in terms of throughput, latency and security. Current systems consist of limitations in mechanical and network capability that limit their use to niche situations such as sniper scenarios. Current systems consist of a one to one correspondence between an analog user interface and a hardwired sniper rifle with a direct cable link on the order of tens of meters maximum distance between the user and the rifle. Current systems allow for a single operator to manually switch the source of video to display between a limited number of collocated and bore-aligned optical scopes each attached to a corresponding sniper rifle. These systems only allow a single user to control a single weapon at a time or view the output of a single optical scope at a time.

Current missile systems generally allow for remote operation from a direct hardwire link. Missile systems are typically hardwired to controller stations and typically do not allow for firing in the event that the individual or hardware responsible for controlling and firing the weapon is somehow incapacitated. Missile system operators are only capable of taking control of one weapon in the system at a time and sensors are generally limited to one radar screen. There are no known missile systems capable of operation over a public network.

Other remote operated weapons systems include the Predator aircraft and other remotely piloted air vehicles. A Predator aircraft is not accessible over a public network and there is no way for an operator to control more than one Predator at a time or switch between a plurality of aircraft since the operator interface for a Predator comprises a single view of an aircraft and is operated by a conventional pilot as if actually flying the aircraft via a ground based cockpit.

These systems fail to achieve maximum force multiplication allowing for a minimal number of operators to operate a maximum number of weapons.

BRIEF SUMMARY OF THE INVENTION

Embodiments of the invention enable the operation of at least one weapon selected from a set of disparate weapons over a public network such as the Internet. Weapons may be lethal or non-lethal. The system may comprise sensors such as a video camera or any other type of sensor capable of detecting a target. Sensors may be collocated or distantly located from weapons and there may be a different number of weapons and sensors in a configuration. Sensors may be aligned parallel with the bore of the weapon and are termed bore-line sensors herein. Sensors not aligned parallel to a weapon are termed non-bore-line sensors herein. An operator may control more than one weapon at a time and may obtain sensor data output from more than one sensor at a time. Embodiments of the system are operable over a public network for example the Internet. Internet based operation may involve user payments and allow for a user to determine a target to fire at. The determination may be made via upload or selection of a target or an image to fire at which may be delivered electronically or physically to the user after firing. The weapon may be fired in a location where the weapon is legal even though it is operated from a location where it would be illegal to physically possess the weapon. The weapon may comprise an automatic weapon for example a machine gun. Embodiments of the invention may couple with and utilize existing video surveillance systems and utilize the imagery obtained from these systems as sensor data. The weapons in the system may be configured to aim at a location pointed at by a sensor whether the sensor is bore-line or not and the sensor data may be presented to the user with aiming projections from at least one weapon superimposed onto the sensor data output from at least one sensor. In addition, one or more weapons may be aimed simultaneously by performing a user gesture such as a mouse click or game controller button selection with respect to a particular sensor data output. Multiple sensor data outputs from multiple sensors including sensors collocated or not with one weapon or more may be simultaneously viewed by one or more operators. An operator user interface may be cloned onto another computer so that other users may watch and optionally record the sensor data and/or user gestures for real-time supervision or for later analysis or training for example. The system may be operated over a secure communications link such as an encrypted link and may require authentication for operation of the weapon or weapons coupled with the system.

The network may comprise any network configuration that allows for the coupling of at least one weapon, at least one sensor and at least one operator user interface over a public network, for example the Internet. An example network configuration for example may be implemented with a combination of wireless, LAN, WAN, or satellite based configurations or any combination thereof coupled with a public network. A second independent network may be utilized in order to provide a separate authorization capability allowing for independent arming of a weapon. All network connections may be encrypted to any desired level with commands and data digitally signed to prevent interception and tampering.

Weapons may include any lethal or non-lethal weapon comprising any device capable of projecting a force at a distance. An example of a weapon includes but is not limited to a firearm, grenade launcher, flame thrower, laser, rail gun, ion beam, air fuel device, high temperature explosive, paint gun, beanbag gun, RPG, bazooka, speaker, water hose, snare gun and claymore. Weapons may be utilized by any operator taking control of the weapon. Weapons may comprise more than one force projection element, such as a rifle with a coupled grenade launcher.

Sensors may comprise bore-line sensors or non-bore-line sensors. Example sensors comprise video cameras in visible and/or infrared, radar, vibration detectors or acoustic sensors any of which may or may not be collocated or aligned parallel with a weapon. A system may also comprise more than one sensor collocated with a weapon, for example a high power scope and a wide angle camera. Alternatively, more weapons than sensors may exist in a configuration. Sensor data output is shareable amongst the operator user interfaces coupled with the network and more than one sensor may be utilized to aim at least one target. Sensors may be active, meaning that they transmit some physical element and then receive generally a reflected physical element, for example sonar or a laser range finder. Sensors may also be passive, meaning that they receive data only, for example an infrared camera or trip wire. Sensors may be utilized by any or all operators coupled with the network.

Operators may require a supervisor to authorize the operation of a weapon, for example the firing of a weapon or any other function associated with the weapon. Operators may take control of any weapon or utilize any sensor data output coupled with the network. An operator may take control over a set of weapons and may observe a sensor data output that is communicated to other operators or weapons in the case of autonomous operation. A second network connection may be utilized in enabling weapons to provide an extra degree of safety. Any other method of enabling weapons independent of the public network may also be utilized in keeping with the spirit of the invention, for example a hardware based network addressable actuator that when deployed does not allow a trigger to fully depress for example. The term client as used herein refers to a user coupled with the system over a public network connection while the term operator as used herein refers to a user coupled with the system over a LAN or WAN or other private network. Supervisors may utilize the system via the public network or a private network. Clients, operators and supervisors may be humans or software processes. For ease of description, the term operator is also used hereinafter as a generic term for clients and supervisors as well, since there is nothing that an operator can do that a client or supervisor cannot do.

Operators may interface to the system with an operator user interface that comprises user gestures such as game controller button presses, mouse clicks, joystick or roller ball movements, or any other type of user input including the blinking of an eye or a voice command for example. These user gestures may occur for example via a graphics display with touch screen, a mouse or game controller select key or with any other type of input device capable of detecting a user gesture. User gestures may be utilized in the system to aim one or more weapons or to follow a target independent of whether sensor data utilized to sense a target is collocated with a weapon or not or parallel to the bore-line of a weapon or not. For bore-line sensors that are collocated with a weapon, translation of the sensor/weapon causes automatic translation of the associated weapon/sensor. The operator user interface may reside on any computing element for example a cell phone, a PDA, a hand held computer, a PC and may comprise a browser and/or a touch screen. Additionally, an operator GUI may comprise interface elements such as palettes of weapons and sensors and glyphs or icons which signify the weapons and sensors that are available to, associated with or under the control of the operator.

A user of the system may control at least one weapon and receive at least one sensor data output via a browser or other Internet-connected client program or via a standalone program. Access via the browser may comprise accessing a website and the web site may be configured to charge a fee for operating the system. In this scenario, a client may determine a target via upload or selection of a target or image to utilize at a remote target facility that may be printed or selected and fired upon, with the resulting target electronically or physically sent back to the client after the target has been fired upon. Alternatively, a client may simply fire upon existing targets.

In order to ensure that system is not stolen and utilized in any undesired manner, a security configuration may disarm the weapons in the system if a supervisor heartbeat is not received in a certain period of time or the weapons in the system may automatically disarm and become unusable if they are moved outside a given area.

BRIEF DESCRIPTION OF THE DRAWINGS

FIG. 12 shows an embodiment of a multipart MIME message comprising at least one JPEG part.

FIG. 13 shows a WEAPON_COMMAND message and a SENSOR_COMMAND message in XML format.

DETAILED DESCRIPTION OF THE INVENTION

Figure 1:
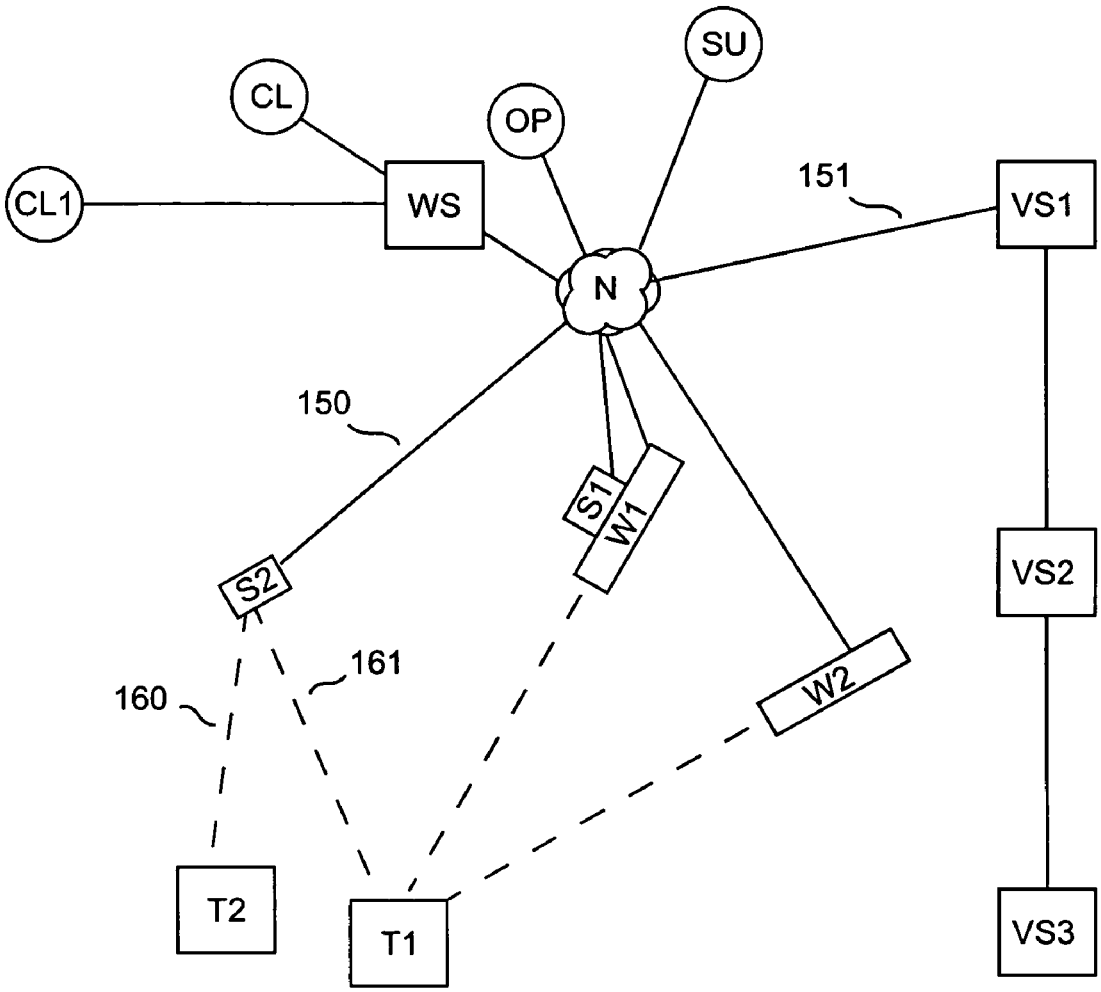
FIG. 1 shows an architectural view of an embodiment of the invention.

Embodiments of the invention enable the operation of at least one weapon selected from a set of disparate weapons over a public network such as the Internet. Weapons may be lethal or non-lethal. The system may comprise sensors such as a video camera or any other type of sensor capable of detecting a target. Sensors may be collocated or distantly located from weapons and there may be a different number of weapons and sensors in a configuration. Sensors may be aligned parallel with the bore of the weapon and are termed bore-line sensors herein. Sensors not aligned parallel to a weapon are termed non-bore-line sensors herein. An operator may control more than one weapon at a time and may obtain sensor data output from more than one sensor at a time. Embodiments of the system are operable over a public network for example the Internet. Internet based operation may involve user payments and allow for a user to determine via upload or selection of a target or an image to fire at which may be delivered electronically or physically to the user after firing. The weapon may be fired in a location where the weapon is legal even though it is operated from a location where it would be illegal to physically possess the weapon. The weapon may comprise an automatic weapon for example a machine gun. Embodiments of the invention may couple with and utilize existing video surveillance systems and utilize the imagery obtained from these systems as sensor data. The weapons in the system may be configured to aim at a location pointed at by a sensor whether the sensor is bore-line or not and the sensor data may be presented to the user with aiming projections from at least one weapon superimposed onto the sensor data output from at least one sensor. In addition, one or more weapons may be aimed simultaneously by performing a user gesture such as a mouse click or game controller button selection with respect to a particular sensor data output. Multiple sensor data outputs from multiple sensors including sensors collocated or not with one weapon or more may be simultaneously viewed by one or more operators. An operator user interface may be cloned onto another computer so that other users may watch and optionally record the sensor data and/or user gestures for real-time supervision or for later analysis or training for example. The system may be operated over a secure communications link such as an encrypted link and may require authentication for operation of the weapon or weapons coupled with the system.

In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Any mathematical references made herein are approximations that can in some instances be varied to any degree that enables the invention to accomplish the function for which it is designed. In other instances, specific features, quantities, or measurements well-known to those of ordinary skill in the art have not been described in detail so as not to obscure the invention. Readers should note that although examples of the invention are set forth herein, the claims, and the full scope of any equivalents, are what define the metes and bounds of the invention.

FIG. 1 shows an architectural view of an embodiment of the invention. Sensor S2 couples with network N via network connection 150. Network connection 150 may be connection based or comprise a wireless connection. Sensor S2 is in a position and orientation to detect target T2 at vector 160 and target T1 at vector 161. For simplicity the solid lines represent network connections and the dashed lines represent vectors, the majority of which are unnumbered in FIG. 1 for ease of illustration. Sensor S2 is not collocated or aligned parallel with the bore-line of a weapon. Sensor S1 is collocated with weapon W1 and is also configured parallel to weapon W1 although there is no requirement for collocated sensor S1 to be configured parallel. Sensor S1 and weapon W1 are shown directed at target T1. Optional Video Surveillance System comprising video surveillance cameras VS1, VS2 and VS3 are shown with network connection 151 capable of communicating commands to the cameras (such as pan/tilt/zoom) and/or transferring images from VS1, VS2 and VS3 onto Network N. VS1 in this embodiment may comprise a commercially available multi-port network addressable analog to digital video converter comprising serial ports for controlling the video cameras and analog input ports for receiving analog video signals. The multi-port network video converter is communicated with over network connection 151 which is used to command video surveillance cameras VS1, VS2 and VS3 and/or obtain image data. Weapon W2 is directed at target T1 by an operator user interface such as used by client CL or operator OP (or supervisor SU) as per a vector at which to point obtained using the sensor data output obtained from sensor S2 and/or S1, or possibly VS1, VS2 or VS3. There is one operator OP coupled with network N in FIG. 1, however any number of operators may simultaneously interface with the system. Operators and clients are users that are coupled with the network N with operators utilizing a standalone program comprising an operator user interface and with clients CL and CL1 interacting with the system via the Internet via browsers and/or other Internet connected program and optionally paying for use of the system and payment may be processed for example via web server WS. Clients, operators and supervisors may be configured to comprise any or all of the functionality available in the system and supervisors may be required by configuration to enter a supervisor password to access supervisor functions. This means that a client may become a supervisor via authentication if the configuration in use allows user type transformations to occur. Operators may also be required to pay for using the system and for embodiments of the invention not comprising web server WS, individual weapons may act as a payment center that allow operators to use the individual weapon for a given time period or number of shots for example. Clients, operators and supervisors may be physically located in a location where physically possessing a weapon such as W1 is illegal while weapons W1 or W2 may be physically located in a location where physically possessing such a weapon is legal. There is one supervisor SU coupled with network N although any number may be coupled with the system. The coupling with an operator or supervisor is optional, but is shown for completeness of illustration. A supervisor may access the operator user interface of a client or operator when the operator user interface is cloned onto the computer of supervisor SU, or supervisor SU may alternatively watch sensor data available to all operators and clients coupled with the system. Although two weapons W1 and W2, and two sensors S1 and S2 are shown in FIG. 1, any number of disparate weapons and disparate sensors may be coupled with network N. Weapons W1, W2, sensors S1 and S2 and video surveillance cameras VS1, VS2 and VS3 may optionally comprise collocated microphones and loud speakers for use by operator OP, clients CL and CL1 and/or supervisor SU.

Each weapon or sensor in the system comprises or is coupled to an addressable network interface and hardware configured to operate and/or obtain information from the coupled weapon or sensor. Embodiments of the weapon and sensor addressable network interfaces may also comprise web servers for web based configuration and/or communication. Web based communication may be in a form compatible with web services.

Initial setup of the system begins with the coupling of weapons and sensors to the network which may comprise in one embodiment of the invention setting the IP addresses of the weapons and sensors to unique values for example. This may involve setting the network address of an addressable network interface associated with or coupled to the weapons and sensors. Alternatively, the weapons and sensors, (or addressable network interfaces associated or coupled to them) may use DHCP to dynamically obtain their addresses. With the number of IP addresses available the maximum number of weapons and sensors is over one billion. Once the network addresses of the various weapons and sensors have been set, they may then be utilized by the operator user interfaces associated with clients CL and CL1, operator OP and supervisor SU.

Figure 9:
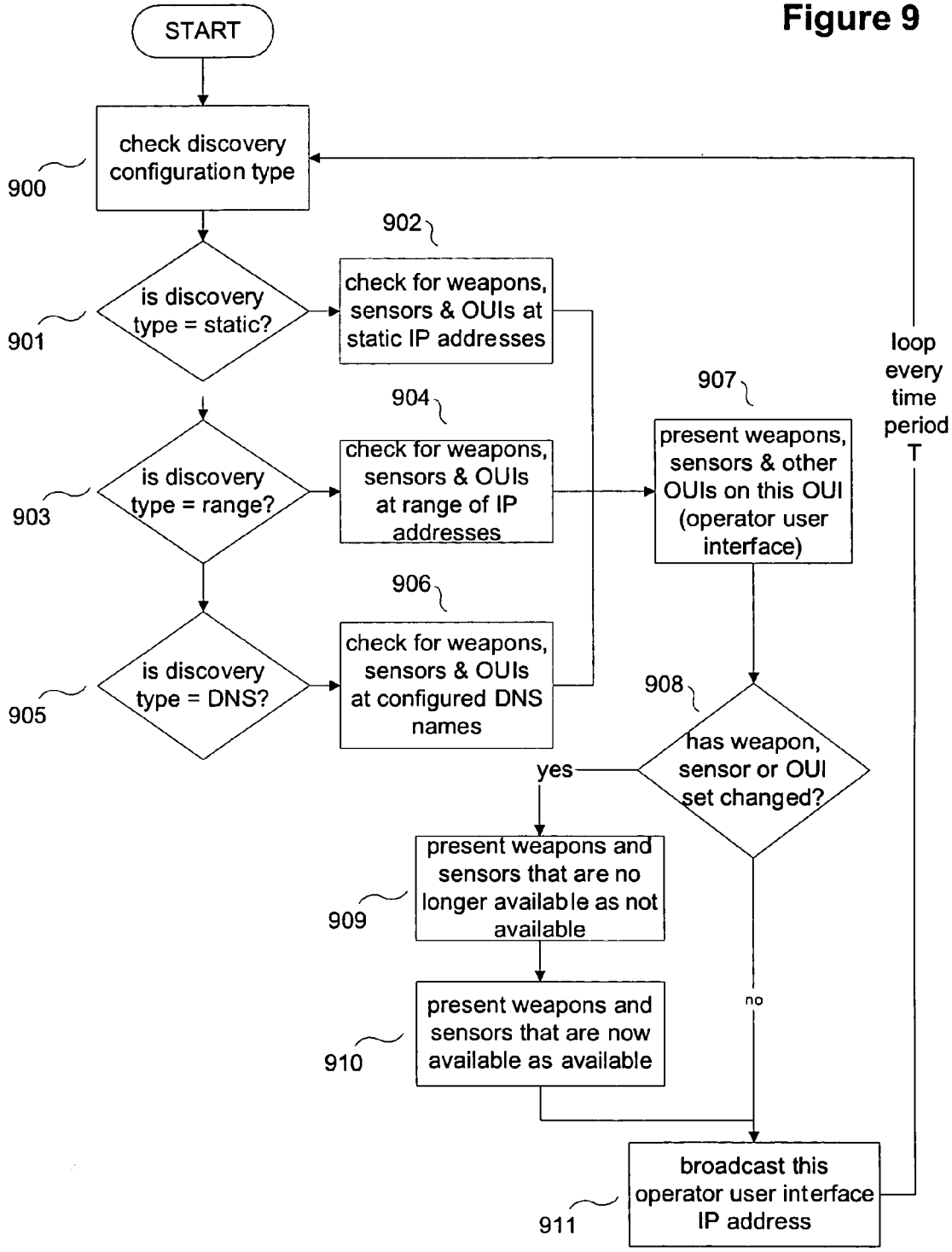
FIG. 9 shows the process of discovering weapons, sensors and operator user interfaces (OUIs).

FIG. 9 shows the flow chart of the discovery process. An embodiment of the operator user interface (OUI) checks the discovery type 900 for the configuration that the OUI is attempting to couple with and if the discovery type is set to use static IP addresses 901 then the OUI checks for weapons, sensors and other OUIs 902 at a specified set of IP addresses. Operators may also manually enter a set of addresses or DNS names dynamically while the system is operational in order to search for other possible weapons and sensors. Alternatively, if the discovery type is set to a range of addresses 903, then the OUI checks for weapons, sensors and other OUIs 904 using a range of IP addresses. For configurations with named weapons, sensors and OUIs, i.e., if discovery type is DNS 905, then the OUI checks for weapons, sensors and OUIs via DNS 906. Another embodiment of the invention may use any combination of these discovery types in dynamically locating weapons, sensors and other OUIs. Other embodiments of the invention may use other types of name servers or directories other than DNS, and make these servers/directories available on the public network. Once the weapons, sensors and OUIs in the configuration have been found, they are presented on the OUI. This may for example comprise the use of glyphs or icons, or lists thereof to graphically show the existing elements in the system, alternatively, this may involve non-visual elements such as computer generated audio. If the weapon, sensor or OUI set has changed 908 then weapons, sensors and OUIs that are no longer available are presented as such 909 and weapons, sensors and OUIs that are now available are presented as such 910. Once the environment has been discovered and updated on the OUI, the IP address of the current OUI is optionally broadcast 911 so that other OUIs may discover this OUI without polling addresses, without checking ranges of addresses or without accessing a directory service such as DNS. Broadcasting the OUI address may also comprise a heartbeat that allows for other OUIs to optionally control weapons formerly controlled by the silent OUI if the configuration in use is set to allow this capability when the OUI fails to broadcast for a configurable time period. This discovery process optionally repeats at every configurable time period T.

After the discovery process, each user may begin communicating with the weapons and sensors via an operator user interface associated with the respective client, operator or supervisor. As shown in FIG. 1, optional supervisor SU is utilizing a standalone application to access the system and does not utilize web server WS, although supervisor SU may opt to interact with the system via web server WS, this is not shown for ease of illustration. In order to select sensor data output to receive, the desired sensor icon is selected on the operator user interface (see FIG. 7). Each user of the system including operator OP, supervisor SU and clients CL and CL1 can view any or all of the sensor data. Each user of the system may control weapons W1 and/or W2 by requesting control of a weapon. Embodiments of the invention allow for each weapon to be controlled by only one user at a time although this is configurable so that an operator may take control of any other weapon, or a weapon may become available for use if a heartbeat is not received from an operator user interface for a configurable time period.

Figure 10:
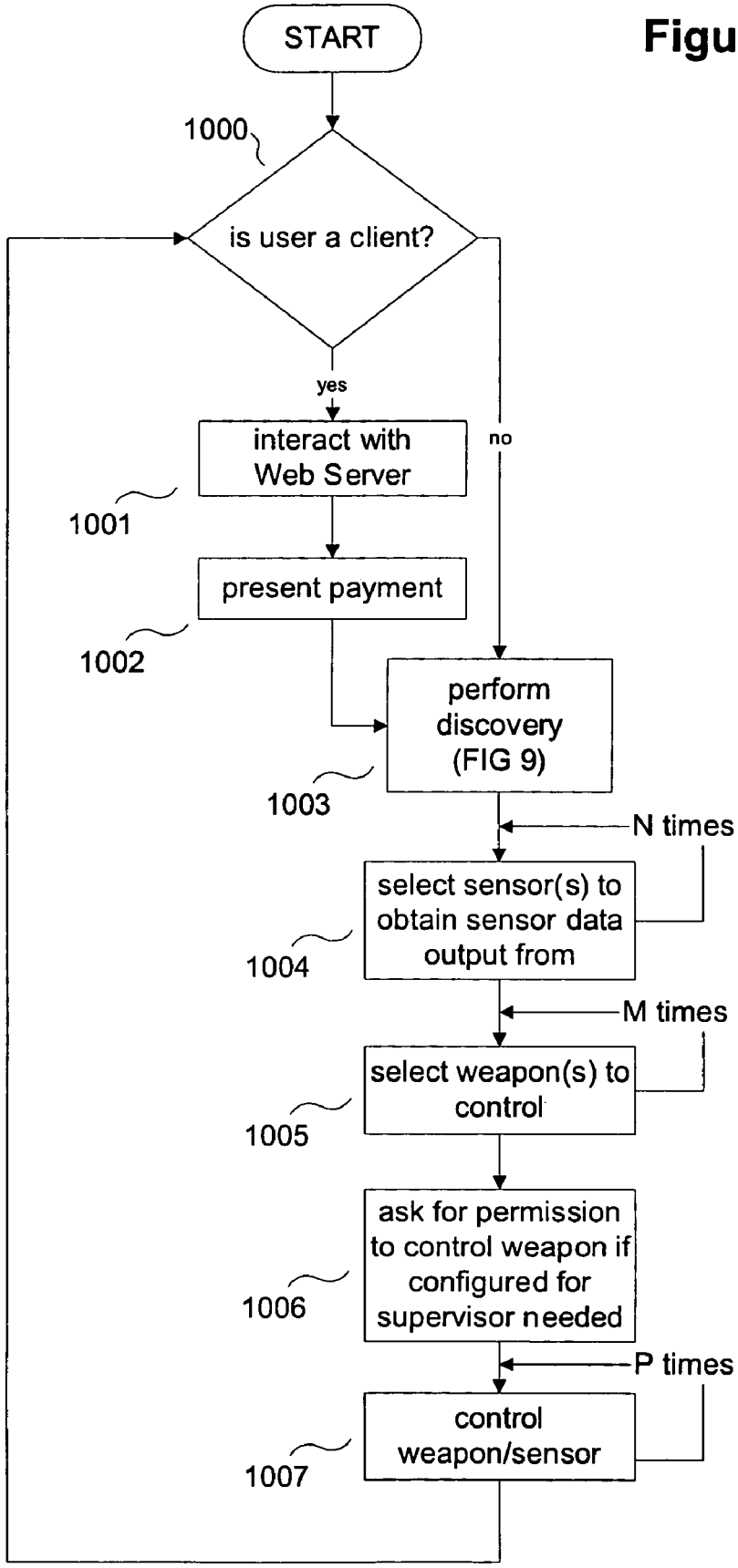
FIG. 10 shows a flowchart depicting the user interaction with the system including selection of sensors and weapons.
Figure 11:
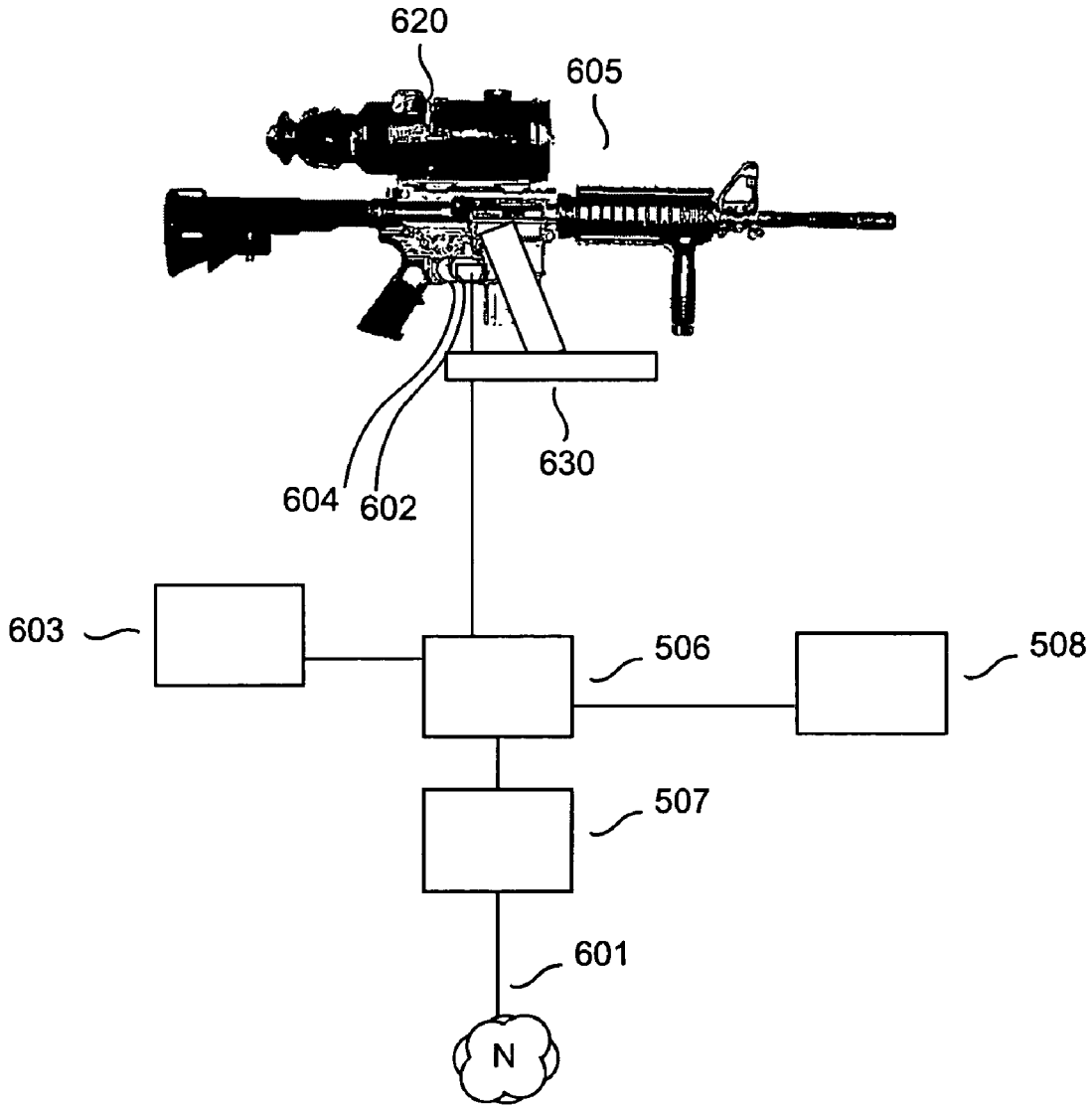
FIG. 11 shows an embodiment of the invention comprising a pan and tilt mount coupled with a weapon.

FIG. 10 shows an example interaction with an embodiment of the invention. If the user is a client (for example CL or CL1) interacting with the system over a public network 1000, then the client interacts with the web server WS in order to obtain a web page and/or applet for interacting with the system 1001. The client then optionally presents payment 1002 for interacting with the system, for example purchases a fixed time, number of rounds to fire, or pays for any other service offered by the site. Other services or equipment that may be paid for on the site may include for example a target upon which to fire or merchandise associated with the website such as a cap or T-shirt. After presenting payment, or in the case of an operator or supervisor where the configuration does not call for payment for these types of users, discovery is performed 1003 (see FIG. 9). After weapons, sensors and other OUIs are discovered a user may then select a sensor to obtain sensor data output from 1004 and this may occur N times, allowing N sensors to present data to the user. The user may then select a weapon to control and this may occur M times, allowing M weapons to be controlled by the user. In addition, the M weapons may be controlled simultaneously by a single user. If the configuration in place requires supervisor permission to control a weapon, then permission is requested at 1006, however this step is optional and depends on the configuration in place. After obtaining any necessary permission, the user may control the M weapons P times, where P is a whole number and may comprise an upper limit set by the payment presented by the user at 1002. Control of the weapon may comprise firing the weapon, panning and tilting the weapon or any other operation associated with the weapon such as arm and disarm. Alternatively, a time slot may be purchased at 1002 that may cause the control weapon/sensor step 1007 to time out and return to step 1000. A weapon or sensor may ignore a command if the weapon or sensor has been moved from an area or aligned in a direction that is not allowed by the configuration in place at the time of the received command at 1007. Disabling a weapon may comprise temporary disablement, permanent disablement or permanent disablement with the intent to destroy the weapon or sensor or possibly any person tampering with the weapon or sensor. As shown in FIG. 11, optional location device 508 is sampled by microcontroller 506 and if the location is deemed out of bounds as per the configuration in place, then if the configuration calls for temporary disablement, then the control weapon/sensor step 1007 is ignored. If the configuration in place specifies permanent disablement, then a non-volatile memory location may be set or cleared to indicate that no operation will ever be delivered to the weapon or sensor. If the configuration in place specifies permanent disablement with the intent to destroy, then optional explosive device 603 in FIG. 11 is activated thereby destroying the weapon/sensor and possibly any person tampering with the weapon or sensor.

Commands and messages sent in the system to/from the weapons and sensors may be sent for example via XML over HTTP over TCP/IP, however any method of communicating commands may be utilized, for example serialized objects over any open port between an operator user interface and a weapon or sensor IP address. XML allows for ease of debugging and tracing of commands since the commands in XML are human readable. The tradeoff for sending XML is that the messages are larger than encoded messages. For example, the XML tag "<COMMAND-HEADER-TYPE>WEAPON_FIRE_COMMAND</COMMAND-HEADER-TYPE>" comprises 62 bytes, while the encoded number for this type of message element may comprises one byte only, for example '0xA9'='169' decimal. For extremely limited communications channels, an encoded transmission layer may be added for translating XML blocks into binary encoded blocks. An embodiment of the invention utilizes multipart/x-mixed-replace MIME messages for example with each part of the multipart message containing data with MIME type image/jpeg for sending images and/or video based sensor data. Sending data over HTTP allows for interfacing with the system from virtually anywhere on the public network since the HTTP port is generally open through all routers and firewalls. XML/RPC is one embodiment of a communications protocol that may be utilized in order to allow for system interaction in a device, hardware, operating system and language independent manner. The system may utilize any type of communications protocol as long as weapons can receive commands and sensors can output data and the weapons and sensors are accessible and discoverable on the public network.

Figure 7:
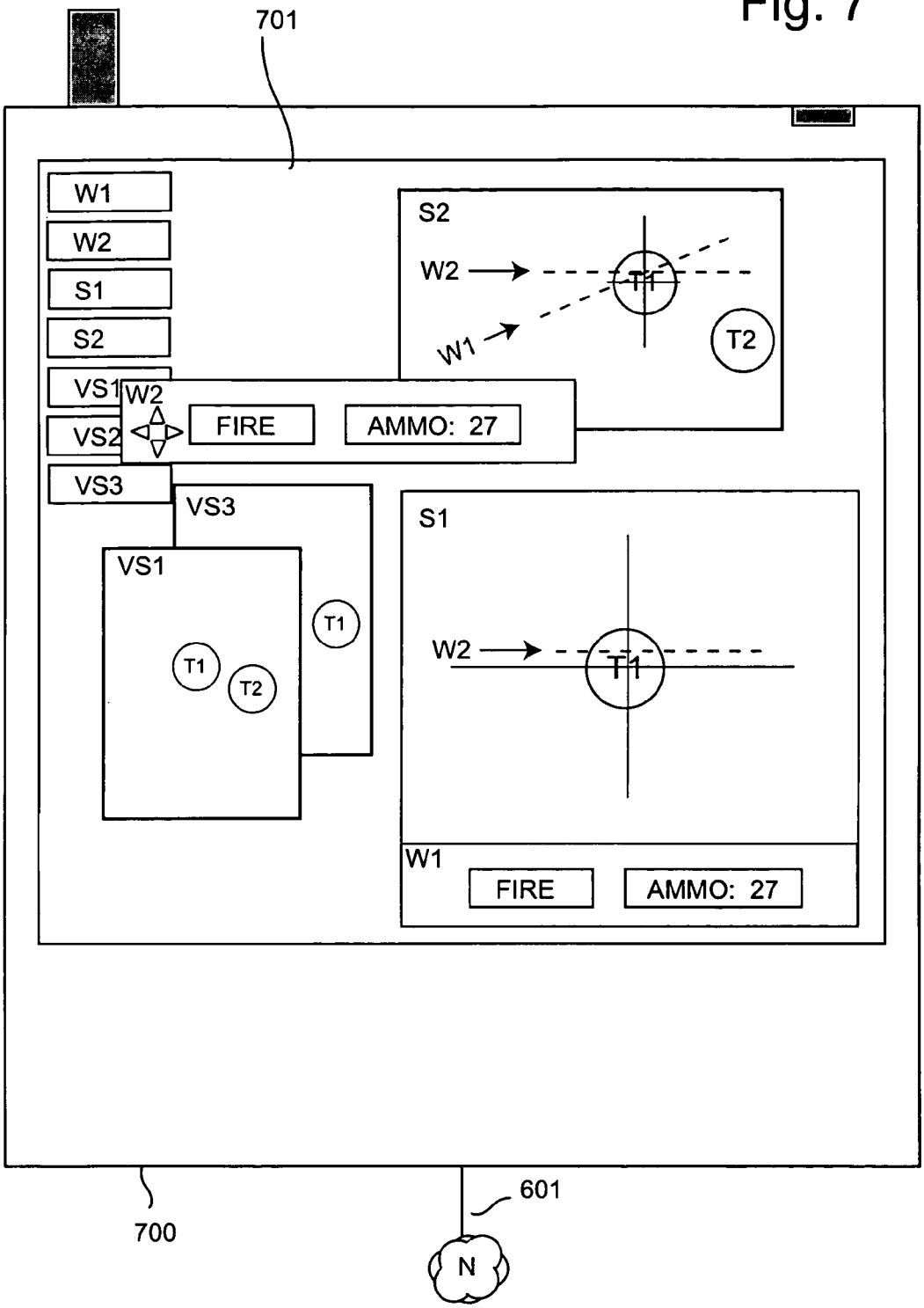
FIG. 7 shows a perspective view of an embodiment of an operator user interface.

In order for an operator to utilize weapon W1, the respective weapon icon is selected in the operator user interface and a weapon user interface is presented to the user allowing entry of commands to the weapon (see FIG. 7). Example commands include commands to pan and tilt and fire the weapon. Supervisor commands may also include commands to enable or disable a weapon or authorize the firing of a weapon at a particular target. Any type of user gesture enabling device may be used to enter commands such as a touch screen, a keyboard and mouse, a game controller, a joystick, a cell phone, a hand held computer, a PDA or any other type of input device. All user gestures and sensor data may be recorded in order to train clients, operators or supervisors or for later analysis. Training may comprise teaching a user to utilize the system or remotely teach a user to utilize a manually operated weapon. For example by utilizing the public network and at least one weapon and at least one sensor, a user may be trained via the public network weapon system to operate a non-remotely operated weapon in lieu of on-site hands-on training. This could be used for example in order to screen possible new recruits for their understanding of firearms operation before allowing them to directly handle a weapon. Alternatively, the user may be trained in the operation of a remotely operated weapon system for an intended site that may or may not comprise a public network. For example the user may be trained on a system comprising a public network connection for eventual work at a site that has no network link to the Internet, i.e., that is LAN based.

Figure 5:
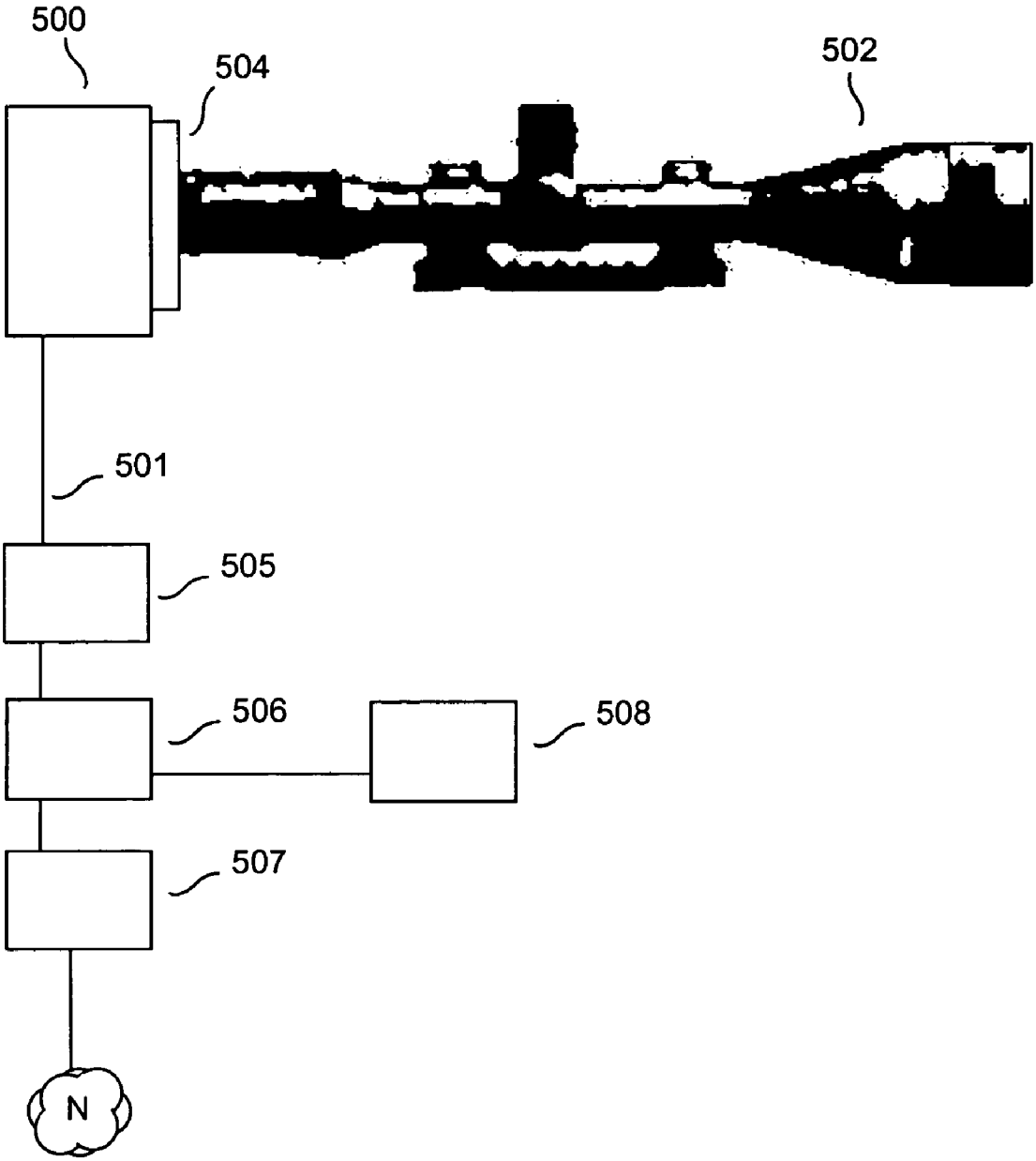
FIG. 5 shows a perspective view of an embodiment of a sensor.

FIG. 5 shows a perspective view of an embodiment of a sensor. Imaging device 500, for example a CCD imager, is coupled with optical scope 502 using flange 504. A sensor may comprise a visual, audio, physical sensor of any type and is not limited to a scope as depicted in FIG. 5 An embodiment of the invention may utilize any commercially available CCD imager. Imaging device 500 comprises video connection 501 which couples imaging device 500 to video card 505. Video card 505 is accessed for video data by a microcontroller 506 and the video data, i.e., sensor data output is transferred out onto network N via network card 507 which comprises an addressable network interface. Microcontroller 506 may also couple with location device 508 (such as a GPS device or any other location device that allows for microcontroller 506 to determine the position of the sensor). If microcontroller 506 determines that location device 508 is producing a location outside of a preconfigured operating area, then microcontroller 506 may erase a key from its non-volatile storage (i.e. flash memory) that allows microcontroller 506 to package and transmit sensor data. Location device 508 may be utilized in calculating or triangular distances to targets in combination with the pan and tilt settings of optical scope 502 for example. Microcontroller 506 takes video data from video card 505 and translates sensor data into the standard protocol(s) used by the public network. The translation may comprise converting the image data into a MIME formatted HTTP message, or may comprise transmission of raw or compressed sensor data in any other format and protocol usable over the public network. The type of image, i.e., the color depth, the compression used and resolution of the image may be changed dynamically in real-time in order to minimize latency and take advantage of available throughput in order to provide the best possible sensor data to the user as will be shown in conjunction with FIG. 8. Sensor 502, here shown as an optical scope may be optionally coupled with a azimuth/elevation (pan and tilt) mount. When coupled directly with a weapon, sensor 502 may be a slave to the motion the associated weapon if the weapon is itself mounted on a pan and tilt mount. Alternatively, collocated weapons and sensors may comprise independent pan and tilt mounts. Microcontroller 506 make comprise a web server to accept and process incoming commands (such as pan, tilt, zoom for example) and requests from operator user interfaces for sensor data and respond with sensor data output in the requested format with depth, compression and resolution. Microcontroller 506 may be optionally configured to communicate and provide functionality as a web service.

Figure 6:
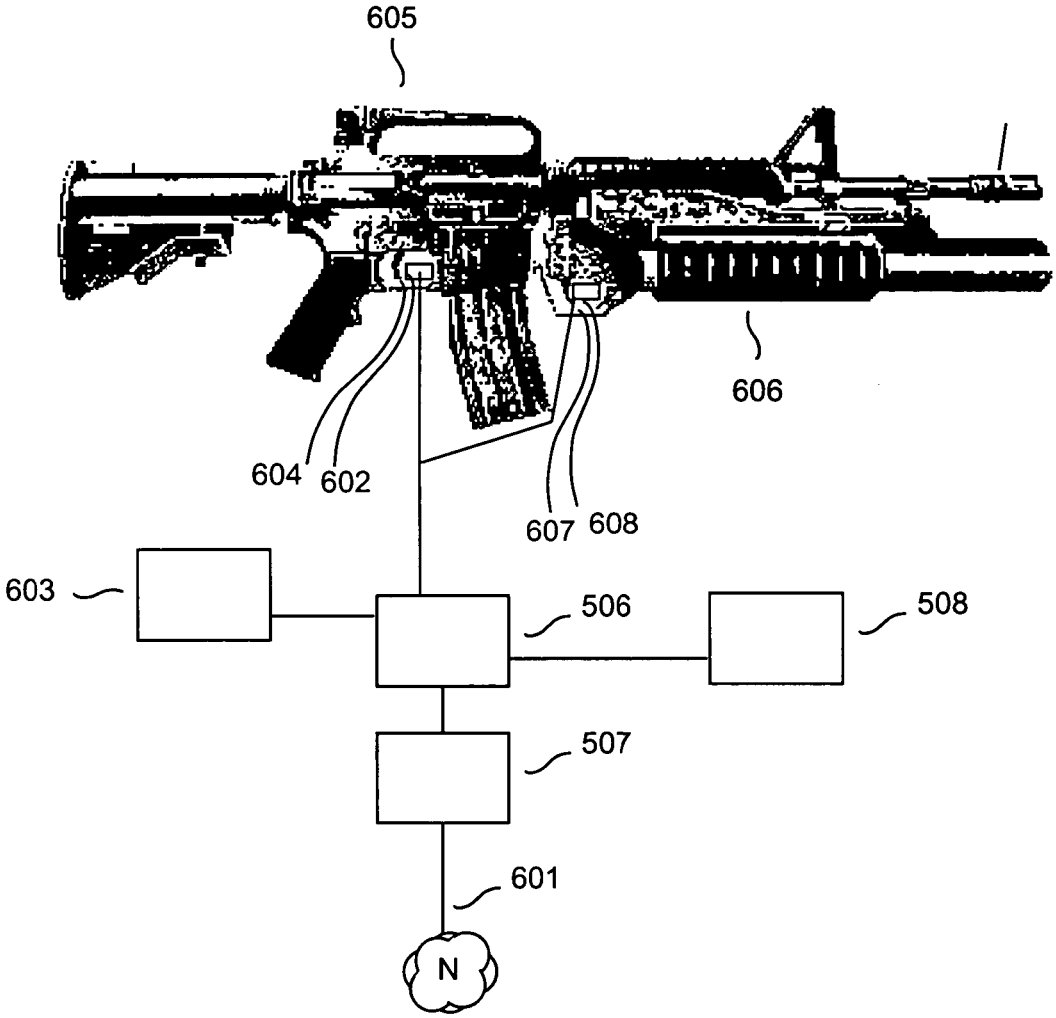
FIG. 6 shows a perspective view of an embodiment of a weapon.

FIG. 6 shows a perspective view of an embodiment of a weapon. Weapon 605 (here for example a full automatic M4 Carbine equipped with M203 grenade launcher 606) may comprise microcontroller 506 and network card 507 and additionally may comprise actuator 602 for example to depress trigger 604 for example. As the embodiment of a weapon 605 comprises a second trigger 607, it also comprises a second actuator 608 to depress second trigger 607. This embodiment of a weapon does not comprise a collocated sensor. In this example an embodiment of the weapon control interface comprises two fire user interface elements. Optional location device 508 may be utilized for area based disarming when for example the weapon system is moved from its intended coverage area. FIG. 11 shows weapon 605 configured with a collocated sensor 620 that is aligned parallel with the bore of weapon 605. In this embodiment, sensor 620 is a night vision scope and weapon 605 is mounted on positioner 630 which is controllable in azimuth and elevation (pan & tilt) by microcontroller 506. Although weapon 605 has been depicted as an M4 carbine, any type of weapon may be utilized. Microcontroller 506 make comprise a web server to accept and process incoming commands (such as fire, pan, tilt, zoom for example) and requests from operator user interfaces for sensor data and respond with sensor data output in the requested format with depth, compression and resolution. Microcontroller 506 may be optionally configured to communicate and provide functionality as a web service. Optional explosive device 603 may comprise an explosive charge set to explode when weapon 605 is moved without authorization, out of ammunition or when location device 508 observes movement outside of an area. The optional explosive device may also be utilized with standalone sensors that sacrifice themselves when commanded for example a sensor coupled with a claymore providing for an explosive device that can be used to observe a target before being commanded to explode. Weapon 605 may comprise any type of weapon and may or may not be collocated with a sensor meaning that a sensor would not have to be destroyed if it was not collocated with the explosive coupled weapon.

FIG. 7 shows a view of an embodiment of an operator user interface. Operator user interface 701 runs on a computer such as computing element 700 for example a standard PC, or a PDA equipped as a cell phone operating via wireless internet connection. Operator user interface comprises user interface elements for example buttons as shown on the left side of the screen for popping up windows associated with the weapons, sensors and video surveillance cameras. The weapons, sensors and video surveillance cameras may appear or disappear from the button group if the individual elements are added or removed from network N. With the configuration as shown in FIG. 1, and using the labels in the upper left of each window in FIG. 7 operator user interface 701 further comprises windows S2, W2, S1 and W1 as a combined window, VS1 and VS3. Targets T1 and T2 may comprise a vehicle or person for example and are shown as circles with the reference characters T1 and T2 inside for ease of illustration. The targets may also be shown in the individual windows with attached graphics or symbols to represent the type of target as annotated by an operator, client or supervisor or via image processing. Window S2 is a sensor display that optionally shows the projected aim points and paths of travel for projectiles fired from the various weapons in the system. For example FIG. 1 shows that weapons W1 and W2 are pointing at target T1. This is shown in window S2 as W2 and W1 with orientation pointers pointing with dashed lines added to sensor data output of sensor S2. When a weapon moves, the operator user interface obtains the movement information and redraws the dashed line to match the orientation of a moved weapon. Target T2 is shown in window S2 without any weapon pointing at it as also shown in FIG. 1. Window S1 shows sensor output data from sensor S1 collocated with weapon W1 and therefore comprises docked weapon control interface W1. Weapon control interface W1 comprises a fire button and an ammunition status field. As S1 and W1 are collocated (with slight parallax since there is a slight bore-line translational displacement) a method for moving weapon W1 comprises a user gesture such as clicking at a different point in window S1, or for example holding a mouse button or game controller button down and dragging left, right, up or down to re-orient the collocated weapon. Window W2 shows an four-way arrow interface that allows weapon W2 to move left, right, up or down which is then shown on displays S1 and S2 as projected aim points and or trajectories. The four way arrow may also simulate a game controller D-pad. D-pads allow input of 8 directions including the four diagonal directions. Video surveillance windows VS1 and VS3 are shown with various targets in them and window VS2 is not shown as the user for example has not selected to view it. An operator may alt-click on a fire button to set it for co-firing when another fire button is selected. Any other method of firing multiple weapons with one user gesture, such as another user interface element such as a window comprising links between buttons for example is within the spirit of the invention. Alternatively a game controller, joystick, or other pointing, moving, controlling device may be utilized to control operator user interface 701 displayed on a computer.

Figure 8:
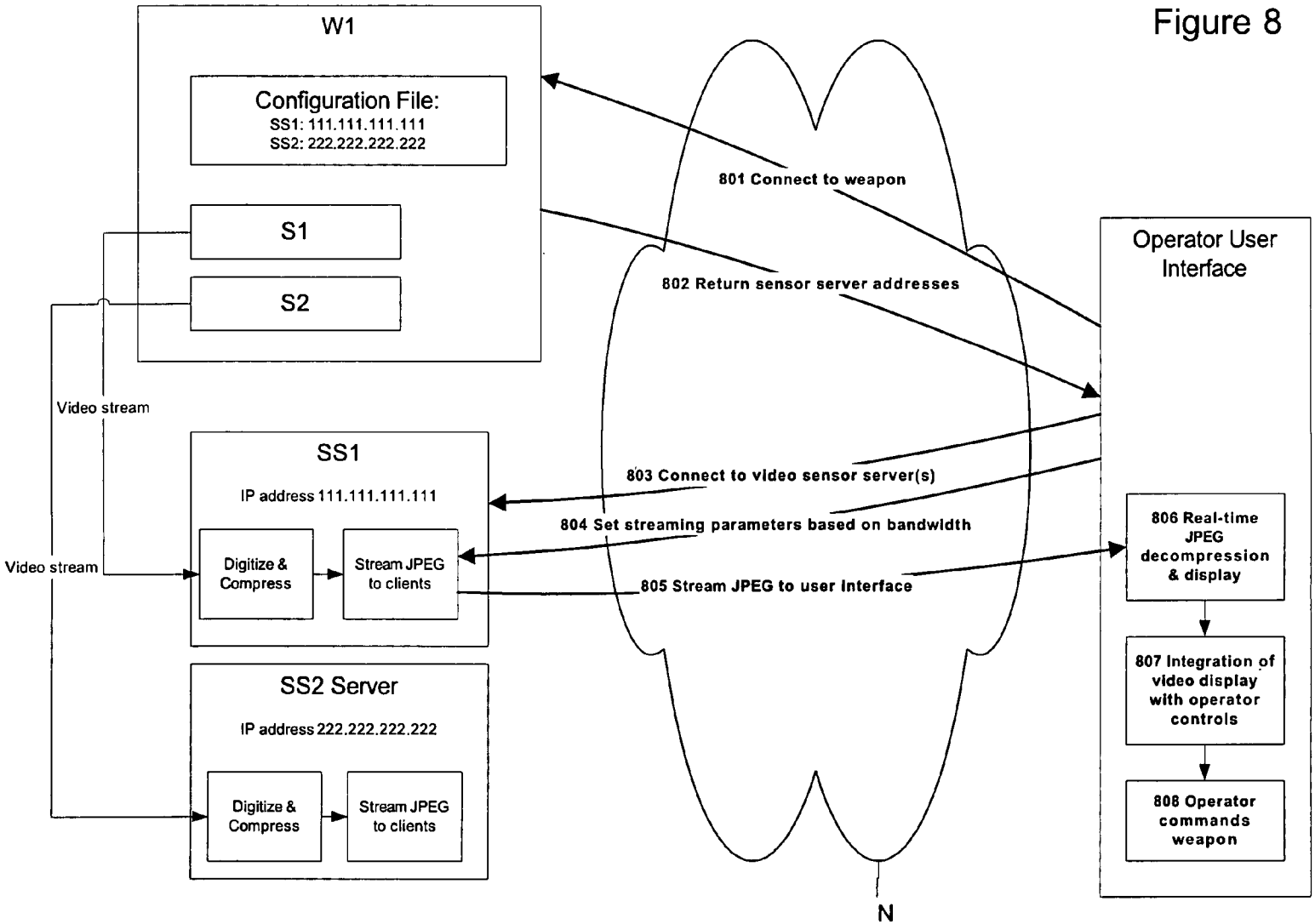
FIG. 8 shows an embodiment of the invention comprising an operator user interface, a weapon and two collocated sensors wherein sensor data is distributed over the public network using a communications protocol for efficiently transferring commands and sensor data.

FIG. 8 shows an embodiment of the invention comprising an operator user interface, weapon W1 and two collocated sensors S1 and S2 wherein sensor data is distributed over the public network using a communications protocol for efficiently transferring commands and sensor data. Real-time control and data distribution over a public network such as the internet is difficult since public networks generally comprise limited bandwidth wherein multiple clients may each observe different data transfer rates, blocked ports, high latency and packet loss. In order to maximize the quality of the sensor data output observed by each client, each operator user interface may be configured to allow a user to configure the sensor data output that is being received or each operator user interface may be configured to automatically negotiate the settings of the sensor data output. In order to maximize the number of clients that may access the system, ports that are generally not blocked by routers or ISPs such as HTTP port 80 or HTTPS port 443 may be utilized in order to send commands and receive sensors data within the system. In order to minimize the effects of high latency and packet loss sensor data may be displayed without being buffered or without use of existing media players that generally buffer video and audio data. As shown in FIG. 8, Operator User Interface connects to weapon W1. The IP address of weapon W1 may be preconfigured, may be polled for in a block of ranges, may be looked up in a DNS server (or any other type of directory server), may be entered by the user, or may be found in any other manner as per FIG. 9. The Configuration File shown associated with weapon W1 may comprise addresses for sensor servers SS1 and SS2. The Configuration File may be resident in non-volatile memory associated with the microcontroller coupled with weapon W1, or may be downloaded in any other manner. Alternatively, sensor servers SS1 and SS2 may also comprise preconfigured IP addresses or may be polled for in a range of addresses or may be looked up from a DNS server for example, i.e., there is no requirement for weapon W1 to be the source for sensor addresses. Sensors S1 and S2 may comprise built-in sensor servers that digitize and compress sensor data, for example video or audio data in which case their addresses may be directly utilized by the Operator User Interface. In one embodiment of the invention, the Operator User Interface connects 801 with weapon W1 over network N and requests any associated sensor or sensor server addresses 802. The Operator User Interface then connects 803 to sensor server SS1, which may comprise for example a video sensor server. Based on the observed response time in connecting 803 to sensor server SS1, or on other measurements of bandwidth, latency, or other network characteristics, parameters may be set 804 in order to account for the latency and observed throughput. Any other method of detecting the effective throughput and latency may be utilized with the system. After the sensor related parameters have been set, for example with respect to a video sensor server, and a user has requested sensor data output from the sensor SS1, sensor data for example JPEG in the case of an optical sensor is streamed to the Operator User Interface 805. In video sensor server embodiments, video streamed at 805 may comprise individual frames compressed into JPEG with varying compression factors based on the streaming parameters set at 804. For example, for a user connected to sensor server SS1 via network N over a high bandwidth DSL line, a large 1024×768 pixel 16 bit color image with minimal compression may be transferred at 30 frames per second whereas a user connected to the same sensor server SS1 via network N over a slow speed cell phone link may opt for or be automatically coupled with a black and 8-bit grey scale 640 by 480 pixel image with high compression to maximize the number of pictures sent per second and minimize the latency of the slower communications link. FIG. 13 shows an example XML command 1301 for a sensor that comprises a pan command portion starting at line 2 of 10.5 degrees and further comprises a throttle command to dynamically alter the resolution and bit depth in order to account for too few pictures per second received at the Operator User Interface. If for example a network link throughput is observed to change, a request from the Operator User Interface either manually input by the user or automatically sent by the Operator User Interface may be sent to sensor server SS1 in order to adjust the depth, resolution, compression or any other parameter associated with a type of sensor in order to optimize observed sensor data output in real-time. Depth, resolution and compression also applies to audio signals with depth corresponding to the number of bits per sample, resolution corresponding to the number of samples per second and compression corresponding to an audio compression format, for example MP3. Any format for picture, video or audio compression may be utilized in keeping with the spirit of the invention, including for example any form of MPEG or MJPEG video compression. When sending picture or video data over HTTP or HTTPS for example, images may be encoded with multipart/x-mixed-replace MIME messages for example with each part of the multipart message containing data with MIME type image/jpeg. FIG. 12 shows an embodiment of a multipart message comprising a descriptive header 1200 that is optional, a first jpeg image 1201 encoded in base 64 and a subsequent "next part" that may comprise as many images or sound clips as are packaged for transmission in this MIME message. After the Operator User Interface receives the sensor data, the sensor data is decompressed 806 and shown on the Operator User Interface 807. Generally available media players buffer data thereby greatly increasing latency which is undesirable for weapons related activities. Any media player constructed to minimize latency may be coupled with the system however. When observing sensor data a user may instruct the weapon control interface portion of the Operator User Interface to fire a weapon or perform any other operation allowed with respect to the weapon 808 for example such as pan and tilt. When sending commands to weapon W1, the commands may be sent in XML in any format that allows weapon W1 to parse and obtain a command, or may be sent in binary encoded format for links that are low bandwidth and/or high in latency in order to maximize utilization of the communications link. FIG. 13 shows an example XML weapon command 1300. The command comprises a time at which to fire and a number of rounds to fire for example. The command may also comprise for example pan and tilt elements that to control the pan and tilt of a weapon. Use of image and audio compression from the sensors that may change dynamically as the communications link fluctuates along with the transmission of XML or encoded binary to the weapons that may also optionally switch formats dynamically to account for fluctuating communications link characteristics yields control that is as close to real-time as is possible over the public network. Note that the XML messages and MIME message are exemplary and may comprise any field desired.

As each user interacts with an operator user interface that is addressable on the network, a supervisor may clone a given user's operator user interface by either directly coupling with the computer hosting the operator user interface and commanding the operator user interface to copy and send input user interface gestures and obtained sensor data output to the supervisor's operator user interface as a clone. Alternatively, the supervisor can obtain the sensor list and weapon list in use by the operator user interface and directly communicate with the sensors and weapons controlled by a given user to obtain the commands and sensor data output that are directed from and destined for the given user's operator user interface. Any other method of cloning a window or screen may be utilized such as a commercially available plug-in in the user's PC that copies the window or screen to another computer.

Figure 2:
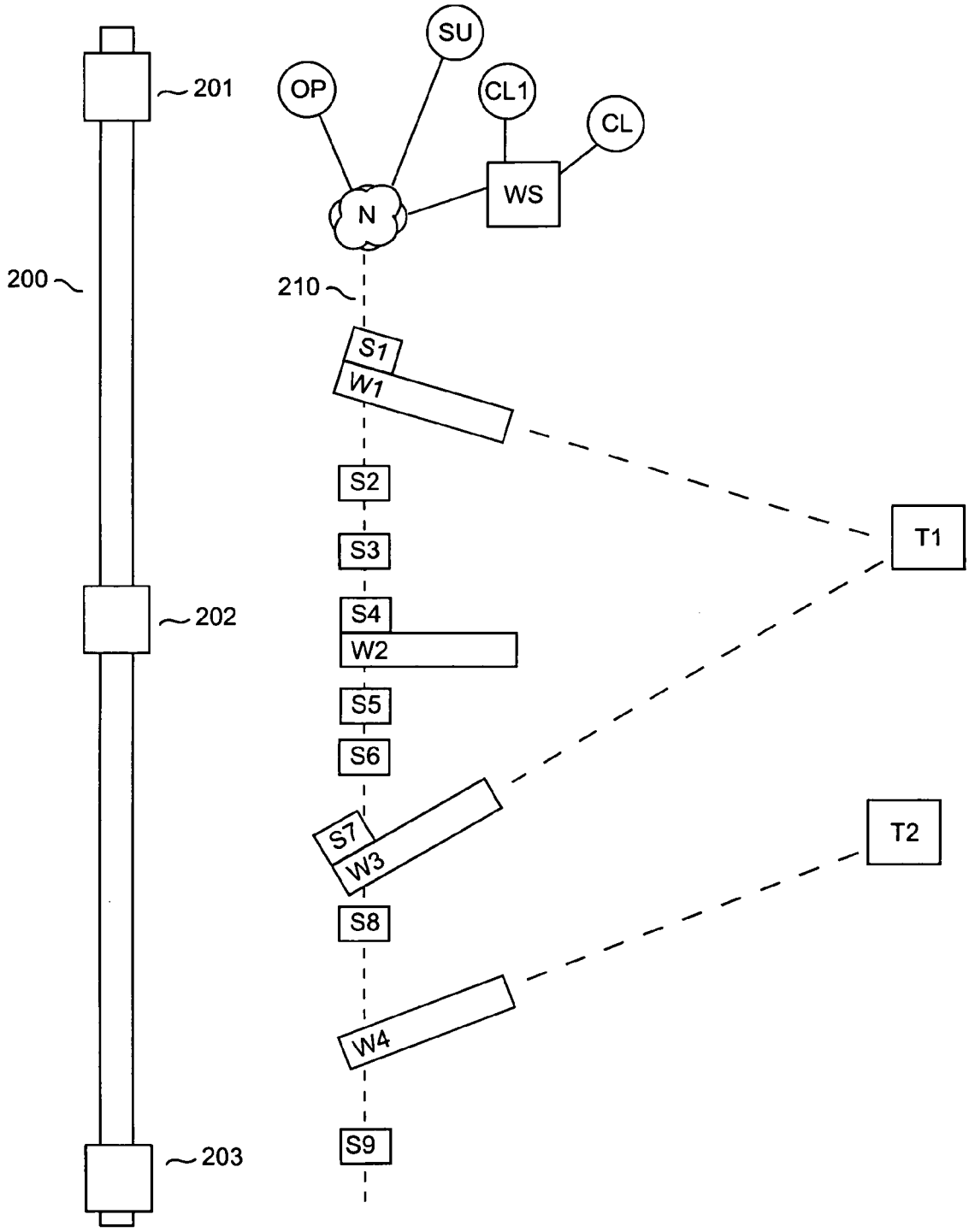
FIG. 2 shows an architecture view of an embodiment of the invention as used for oil pipeline defense.

FIG. 2 shows an architecture view of an embodiment of the invention as used for oil pipeline defense. Oil pipeline 200 comprises pumping stations 201, 202 and 203. The dimensions between pumping station may be on the order of kilometers. An array of sensors and weapons coupled with network N reside near the pipeline on both sides, one side (as shown for ease of illustration), or above or below the pipeline. The connection to network N is shown as a wireless network 210. Wireless network 210 may comprise satellite communication or microwave links for example. Use of a hardwired buried cable is also possible although a rupture in the line may disable some or all of the weapons and sensors depending on the exact nature of the rupture. As shown in the FIG. 2, two targets T1 and T2 exist and are being aimed at by weapons W1, W3 and W4. Weapons W1 and W3 comprise collocated sensors S1 and S7 respectively while weapon W4 does not comprise a collocated sensor or a collocated sensor is inoperable although weapon W4 is still usable by any user of the system. As shown there are a different number of sensors as there are weapons and as sensors are generally cheaper than weapons, it may be cost effective to deploy more sensors than weapons. In addition, since weapons may have an extended range, one embodiment of the invention may deploy one weapon roughly every half kilometer while deploying more sensors near ravines or by roadways for redundancy and robustness for example roughly at 100 meter offsets. Any distance may be utilized for separating weapons and sensors. When a user for example client CL determines that target T1 for example is a foe, client CL may take control of weapons W1 and W3 and fire both weapons simultaneously at target T1 with one user gesture, for example a single mouse click, game control button press or voice command. In another scenario, operator OP and client CL1 may take control of weapons W1 and W3 respectively and independently fire at target T1 or alternatively communicate with each other and pre-plan and execute a coordinated attack. Another possible scenario allows for supervisor SU to authorize the firing of weapon W4 at target T2. A small number of users may be utilized to defend an extremely long pipeline and since the users may be stacked in shifts, the pipeline may be defended around the clock for every day of the year.

Figure 3:
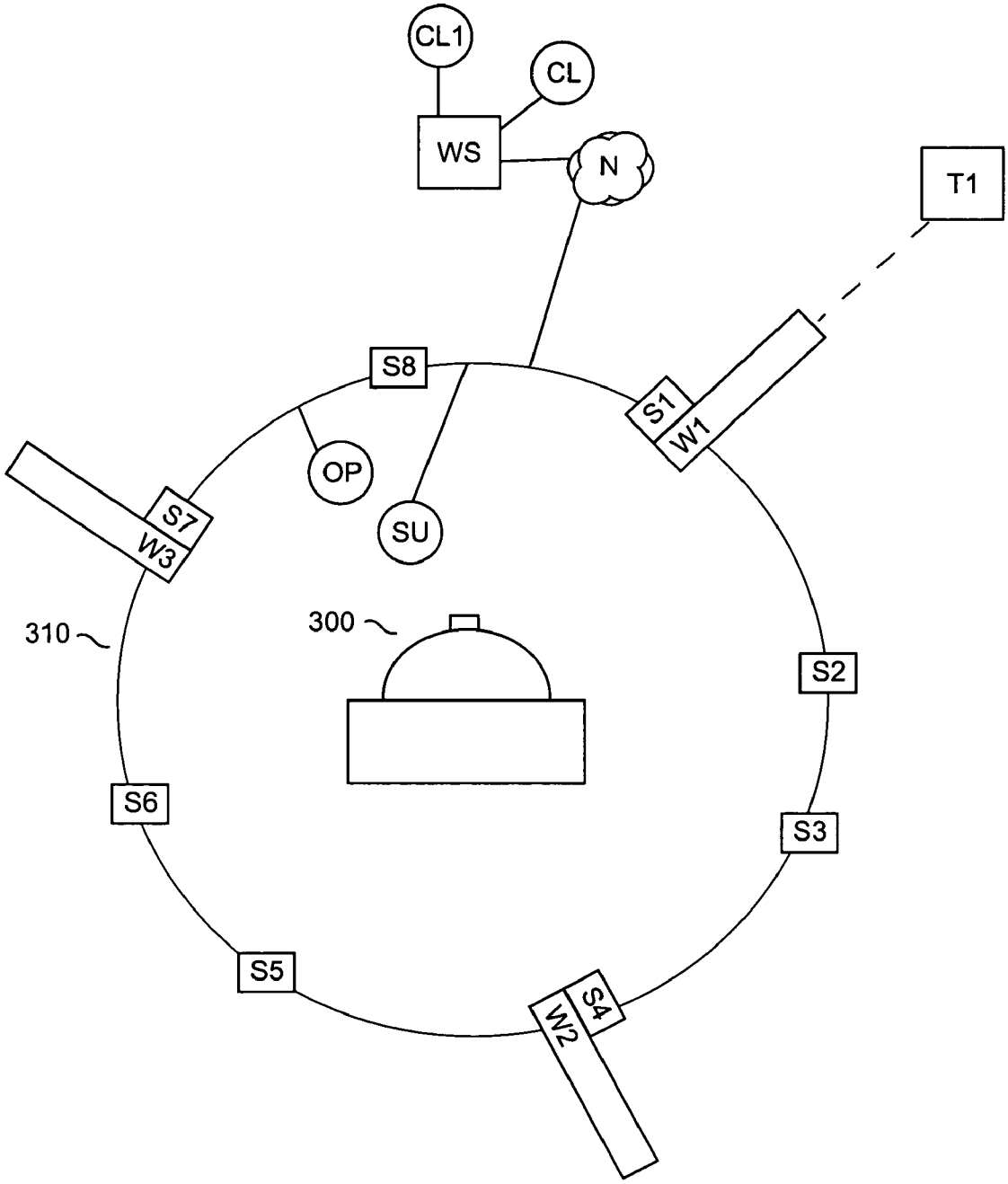
FIG. 3 shows an architecture view of an embodiment of the invention as used for nuclear facility defense.

FIG. 3 shows an architecture view of an embodiment of the invention as used for nuclear facility defense. Nuclear facility 300 may be a nuclear reactor or a nuclear missile site for example. Weapons W1, W2 and W3 are pointed away from nuclear facility 300 in general and are coupled with network 310 shown as a hardened Ethernet link for example a buried cable. Other weapons may be pointed inward to protect against insider attacks or as a final defense if the perimeter defenses are breached. Wireless communications may also be used in network 310. Network 310 couples optionally with network N which allows users CL and CL1 for example to control the weapons. For security reasons high bit level encryption and digital signatures may be utilized in order to safely operate the system. Optionally, access via network N may be enabled only if a supervisory or operator heartbeat is not seen for a given period of time which may indicate that the users within the facility may have been injured or unable to perform the vital function of protecting the nuclear facility. In addition, as the system may be delivered to a country that has a surplus of atomic weapons and a minimal number of resources to protect the weapons, the system may comprise elements that determine the location of the element and disable that element from operating if the system has been moved. This would ensure that systems delivered to countries for defensive purposes are not later used for offensive purposes in another location.

Figure 4:
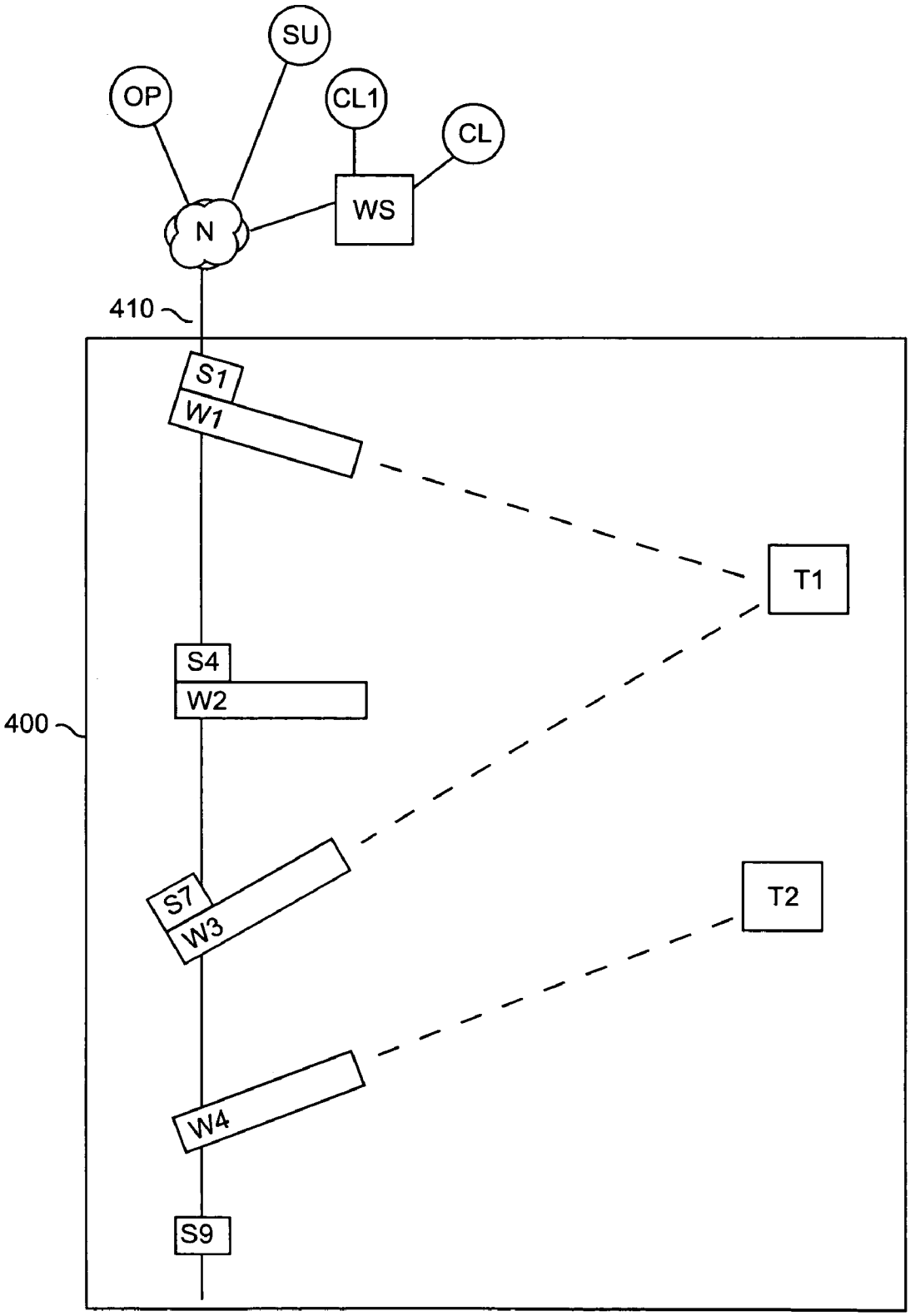
FIG. 4 shows an architecture view of an embodiment of the invention as used for an online shooting gallery.

FIG. 4 shows an architecture view of an embodiment of the invention as used for an online shooting gallery. An embodiment of the invention configured as an online shooting gallery 400 may comprise a building capable of stopping any projectile fired by weapons W1, W2, W3 or W4. Optionally, online shooting gallery 400 may comprise an area suitable for firing weapons W1, W2, W3 and W4 that does not comprise an enclosed building such as an outdoor shooting range. Network 410 may comprise a simple Ethernet cable or wireless connections that are not required to be hardened or protected. Operator OP may operate weapon W4 while client CL may simultaneously operate weapons W1 and W3. Alternatively, web server WS may be configured to only allow one client at a time to operate one weapon at a time by controlling requests for weapons. Each weapon may send a heartbeat to show that it is still capable of communication and who is controlling the weapon. In this configuration, it is also possible to only allow a user access to a single sensor, even if that sensor is not collocated with the weapon as would be the case for weapon W4 and sensor S9. Web server WS may be configured to accept payment before use of each weapon and may comprise time limits for operation and/or charge for the number of rounds fired. An on-site range master would not be required for closed building operation since the only operation required would be to ensure that the weapons remain loaded. Each user using the system may determine a target upon which to fire either by uploading a target or image or utilizing a target or image selected from a list that is printed down range for example with a printer that is suitably shielded in the direction of weapons W1, W2, W3 and W4 and fired upon. Alternatively, pre-existing targets may be fired upon that are selected but not downloaded by the user and may be explosive in nature. After being fired upon, the target may be electronically scanned or imaged and sent to the user or may be physically mailed to the user along with any scoring or notes from the range master. Since many locations do not allow firearms or have laws denying users to physically own particular firearms, these firearms may be utilized by embodiments of the invention in locations where the weapons are legal to own even if the location that a user is operating the weapon from is a location where physical ownership of the weapon is illegal. This may include operation of automatic machine guns or explosive devices for example. Supervisor SU may clone the window of a given user and observe what the user is observing and doing in order to ensure for example that a particular weapon is working correctly, or for scoring or training purposes.

By cloning an operator user interface and providing feedback from a teacher to a user that is currently utilizing the system or by recording the user gestures and/or sensor data output as viewed by a user real-time or delayed training and analysis is achieved. The training may be undertaken by users distantly located for eventual operation of an embodiment of the invention partitioned into a different configuration. The training and analysis can be provided to users of the system in order to validate their readiness and grade them under varying scenarios. The clients may eventually all interact with the system as operators over a LAN for example or may be trained for use of firearms in general, such as prescreening applicants for sniper school. By injecting actual or simulated targets into the system, clients may fire upon real targets and be provided with feedback in real terms that allow them to improve and allow managers to better staff or modify existing configurations for envisioned threats or threats discovered after training during analysis.

Thus embodiments of the invention directed to a Public Network Weapon System and Method have been exemplified to one of ordinary skill in the art. The claims, however, and the full scope of any equivalents are what define the metes and bounds of the invention.

What is claimed is:

1. A public network weapon system comprising:

a public network;

at least one sensor configured to produce a corresponding at least one sensor data output wherein said at least one sensor is coupled with said public network and wherein a first sensor selected from said at least one sensor produces a first sensor data output;

at least one operator user interface configured to execute in a computer system having a tangible memory medium, where said computer system is coupled with said public network and said at least one user interface is configured to communicate with and present said at least one sensor data output and wherein said at least one operator user interface comprises at least one weapon control interface;

at least one weapon coupled with said public network wherein said at least one weapon control interface is configured to deliver a command to said at least one weapon; and, a communications protocol compatible with said public network that allows said operator user interface to communicate with said at least one weapon and said at least one sensor.

2. The public network weapon system of claim 1 wherein said first sensor comprises a network addressable interface coupled to said first sensor that receives commands sent via said public network requesting sensor data and responds with data from said first sensor in a format that is compatible with said public network.

3. The public network weapon system of claim 1 wherein a first weapon selected from said at least one weapon comprises a network addressable interface coupled to said first weapon that receives commands sent via said public network to operate said first weapon and issues instructions to one or more devices attached to said first weapon to operate said first weapon.

4. The public network weapon system of claim 1 wherein said communications protocol comprises HTTP or HTTPS.

5. The public network weapons system of claim 1 wherein said communications protocol comprises a format transmitted using Internet Protocol.

6. The public network weapon system of claim 1 wherein said communications protocol comprises XML format or encoded format.

7. The public network weapon system of claim 1 wherein said communications protocol allows for alteration of compression or depth or resolution or alteration of any combination of compression, depth and resolution of said at least one sensor data output to minimize latency and maximize quality of sensor data output.

8. The public network weapon system of claim 7 wherein said alteration occurs dynamically.

9. The public network weapon system of claim 1 wherein said communications protocol comprises dynamic discovery of said at least one weapon.

10. The public network weapon system of claim 1 wherein said communications protocol comprises dynamic discovery of said at least one sensor.

11. The public network weapon system of claim 1 wherein said communications protocol comprises dynamic discovery of said at least one operator user interface.

12. The public network weapon system of claim 1 further comprising:

a website configured to accept payment for use of said at least one operator user interface by at least one user.

13. The public network weapon system of claim 1 further comprising a target wherein said target is determined by a user.

14. The public network weapon system of claim 1 wherein a target is returned to a user after said at least one operator user interface is commanded to fire by said user.

15. The public network weapon system of claim 14 further comprising a target wherein said target is sent to said user electronically.

16. The public network weapon system of claim 14 further comprising a target wherein said target is sent to said user via mail.

17. The public network weapon system of claim 1 wherein said at least one weapon comprises a weapon located in a location where said weapon is legal to own and is operated over said public network from a location where said weapon is not legal to own.

18. The public network weapon system of claim 1 wherein said at least one weapon comprises an automatic weapon located in a location where said full automatic weapon is legal to own and is operated over said public network from a location where said automatic weapon is not legal to own.

19. The public network weapon system of claim 1 wherein said at least one weapon and said at least one sensor are arranged proximate to an oil pipeline.

20. The public network weapon system of claim 1 wherein said at least one weapon and said at least one sensor are arranged proximate to a nuclear facility.

21. The public network weapon system of claim 1 wherein said at least one weapon is configured to disable if removed from an area.

22. The public network weapon system of claim 1 wherein said at least one weapon and said at least one sensor are configured as an online shooting gallery.

23. The public network weapon system of claim 1 wherein said at least one sensor is a bore-line sensor.

24. The public network weapon system of claim 1 wherein said at least one sensor is a non-bore-line sensor.

25. The public network weapon system of claim 1 wherein said at least one sensor is a component of a video surveillance system.

26. The public network weapon system of claim 1 wherein said at least one weapon is authorized for operation by a supervisor.

27. The public network weapon system of claim 1 wherein said at least one weapon control interface is configured to aim said at least one weapon based on a user interface gesture with respect to at least one sensor data output from said at least one sensor.

28. The public network weapon system of claim 1 wherein said at least one operator user interface is cloned onto a second computer.

29. The public network weapon system of claim 1 wherein said public network comprises secure communications between said at least one operator user interface and said at least one weapon.

30. The public network weapon system of claim 1 wherein said public network comprises authentication.

31. The public network weapon system of claim 1 wherein said at least one operator user interface comprises an input device selected from the group consisting of touch screen, keyboard and mouse, game controller, handheld computer, cell phone and PDA.

32. The public network weapon system of claim 1 wherein said at least one operator user interface is configured to operate, pan and tilt of said at least one sensor.

33. The public network weapon system of claim 1 wherein said at least one weapon control interface is configured to operate, pan and tilt of said at least one weapon.

34. The public network weapon system of claim 1 wherein user gestures are recorded for subsequent analysis or training.

35. The public network weapon system of claim 1 wherein said at least one sensor data output is recorded for subsequent analysis or training.

36. A method for utilizing a public network weapon system comprising:

coupling at least one sensor configured to produce a corresponding at least one sensor data output with a public network wherein a first sensor selected from said at least one sensor produces a first sensor data output;

presenting at least one operator user interface configured to execute in a computer system having a tangible memory medium, where said computer system is coupled with said public network and said at least one user interface is configured to communicate with and present said at least one sensor data output and wherein said at least one operator user interface comprises at least one weapon control interface;

communicating via a communications protocol compatible with said public network that allows said operator user interface to communicate with said at least one weapon and said at least one sensor; and, delivering a command to at least one weapon coupled with said public network wherein said command is generated via said at least one weapon control interface.

37. The method for utilizing a public network weapon system of claim 36 wherein said communicating comprises utilizing a network addressable interface coupled to said first sensor that receives commands sent via said public network requesting sensor data and responds with data from said first sensor in a format that is compatible with said public network.

38. The method for utilizing a public network weapon system of claim 36 wherein said communicating comprises utilizing a network addressable interface coupled to a first weapon selected from said at least one weapon wherein said first weapon receives commands sent via said public network to operate said first weapon and issues instructions to one or more devices attached to said first weapon to operate said first weapon.

39. The method for utilizing a public network weapon system of claim 36 wherein said communicating comprises sending information over HTTP or HTTPS.

40. The method for utilizing a public network weapon system of claim 36 wherein said communicating comprises sending information using Internet Protocol.

41. The method for utilizing a public network weapon system of claim 36 wherein said communicating comprises sending information in XML format or encoded format or a combination of XML format and encoded format.

42. The method for utilizing a public network weapon system of claim 36 further comprising:

altering compression or depth or resolution or altering any combination of compression, depth and resolution of said at least one sensor data output to minimize latency and maximize quality of sensor data output.

43. The method for utilizing a public network weapon system of claim 36 wherein said altering occurs dynamically.

44. The method for utilizing a public network weapon system of claim 36 wherein said communicating further comprises dynamic discovery of an item selected from the group consisting of weapon, sensor and operator user interface.

45. The method for utilizing a public network weapon system of claim 36 further comprising:

accepting payment on a website for use of said at least one operator user interface by at least one user.

46. The method for utilizing a public network weapon system of claim 36 further comprising:

determining a target to use via input from a user.

47. The method for utilizing a public network weapon system of claim 36 further comprising:

returning a target to a user after said at least one operator user interface is commanded to fire by said user.

48. The method for utilizing a public network weapon system of claim 36 further comprising:

operating said at least one weapon comprising a weapon located in a location where said weapon is legal to own and is operated over said public network from a location where said weapon is not legal to own.

49. The method for utilizing a public network weapon system of claim 36 further comprising:

operating said at least one weapon comprising an automatic weapon located in a location where said automatic weapon is legal to own and is operated over said public network from a location where said full automatic weapon is not legal to own.

50. The method for utilizing a public network weapon system of claim 36 further comprising:

utilizing said at least one weapon and said at least one sensor when arranged proximate to an oil pipeline.

51. The method for utilizing a public network weapon system of claim 36 further comprising:

utilizing said at least one weapon and said at least one sensor when arranged proximate to a nuclear facility.

52. The method for utilizing a public network weapon system of claim 36 further comprising:

disabling said at least one weapon if said at least one weapon is removed from an area.

53. The method for utilizing a public network weapon system of claim 36 further comprising:

utilizing said at least one weapon and said at least one sensor as an online shooting gallery.

54. The method for utilizing a public network weapon system of claim 36 further comprising:

utilizing said at least one sensor wherein said at least one sensor is a component of a video surveillance system.

55. The method for utilizing a public network weapon system of claim 36 further comprising:

training a user to utilize said at least one weapon and said at least one sensor over said public network.

56. The method for utilizing a public network weapon system of claim 36 further comprising:

utilizing said public network and said at least one weapon and said at least one sensor to train a user to operate a weapon.

57. The method for utilizing a public network weapon system of claim 36 further comprising:

utilizing said public network and said at least one weapon and said at least one sensor to train a user to operate a remotely operated weapon.

58. The method for utilizing a public network weapon system of claim 36 further comprising:

presenting at least one aiming projection on said at least one weapon control interface of said at least one weapon in combination with at least one sensor data output from said at least one sensor.

59. The method for utilizing a public network weapon system of claim 36 further comprising:

aiming said at least one weapon via said at least one weapon control interface based on a user interface gesture with respect to at least one sensor data output from said at least one sensor.

60. The method for utilizing a public network weapon system of claim 36 further comprising:

cloning said at least one operator user interface onto a second computer.

61. The method for utilizing a public network weapon system of claim 36 further comprising:

communicating over said public network via secure communications.

62. The method for utilizing a public network weapon system of claim 36 further comprising:

authenticating a user via said public network.

63. The method for utilizing a public network weapon system of claim 36 further comprising:

allowing entry of user input gestures to said at least one operator user interface via an input device selected from the group consisting of touch screen, keyboard and mouse, game controller, handheld computer and PDA.

64. The method for utilizing a public network weapon system of claim 36 further comprising:

recording user gestures for subsequent analysis or training.

65. The method for utilizing a public network weapon system of claim 36 further comprising:

recording said at least one sensor data output for subsequent analysis or training.

66. A public network weapon system comprising:

means for coupling at least one sensor configured to produce a corresponding at least one sensor data output with a public network wherein a first sensor selected from said at least one sensor produces a first sensor data output;

means for presenting at least one operator user interface configured to execute in a computer system having a tangible memory medium, where said computer system is coupled with said public network and said at least one user interface is configured to communicate with and present said at least one sensor data output and wherein said at least one operator user interface comprises at least one weapon control interface; and, means for communicating via a communications protocol compatible with said public network that allows said operator user interface to communicate with said at least one weapon and said at least one sensor; and, means for delivering a command to at least one weapon coupled with said public network wherein said command is generated via said at least one weapon control interface.

67. The public network weapon system of claim 66 wherein said communicating comprises means for utilizing a network addressable interface coupled to said first sensor that receives commands sent via said public network requesting sensor data and responds with data from said first sensor in a format that is compatible with said public network.

68. The public network weapon system of claim 66 wherein said communicating comprises means for utilizing a network addressable interface coupled to a first weapon selected from said at least one weapon wherein said first weapon receives commands sent via said public network to operate said first weapon and issues instructions to one or more devices attached to said first weapon to operate said first weapon.

69. The public network weapon system of claim 66 wherein said means for communicating comprises means for sending information over HTTP or HTTPS.

70. The public network weapon system of claim 66 wherein said means for communicating comprises means for sending information using Internet Protocol.

71. The public network weapon system of claim 66 wherein said means for communicating comprises means for sending information in XML format or encoded format or a combination of XML format and encoded format.

72. The public network weapon system of claim 66 further comprising:

means for altering compression or depth or resolution or altering any combination of compression, depth and resolution of said at least one sensor data output to minimize latency and maximize quality of sensor data output.

73. The public network weapon system of claim 66 wherein said means for altering compression is configured to perform dynamically.

74. The public network weapon system of claim 66 further comprising:

means for communicating further comprises dynamic discovery of an item selected from the group consisting of weapon, sensor and operator user interface.

75. The public network weapon system of claim 66 further comprising:

means for operating said at least one weapon comprising a weapon located in a location where said weapon is legal to own and is operated over said public network from a location where said weapon is not legal to own.

76. The public network weapon system of claim 66 further comprising:

means for operating said at least one weapon comprising an automatic weapon located in a location where said full automatic weapon is legal to own and is operated over said public network from a location where said automatic weapon is not legal to own.

77. The public network weapon system of claim 66 further comprising:

means for disabling said at least one weapon if said at least one weapon is removed from an area.

78. The public network weapon system of claim 66 further comprising:

means for utilizing said at least one sensor wherein said at least one sensor is a component of a video surveillance system.

79. The public network weapon system of claim 66 further comprising:

means for presenting at least one aiming projection on said at least one weapon control interface of said at least one weapon in combination with at least one sensor data output from said at least one sensor.

80. The public network weapon system of claim 66 further comprising:

means for aiming said at least one weapon via said at least one weapon control interface based on a user interface gesture with respect to at least one sensor data output from said at least one sensor.

81. The public network weapon system of claim 66 further comprising:

means for recording user gestures for subsequent analysis or training.

82. The public network weapon system of claim 66 further comprising:

means for recording said at least one sensor data output for subsequent analysis or training.

* * * * *